US009420368B2

(12) United States Patent
Stein et al.

(10) Patent No.: US 9,420,368 B2
(45) Date of Patent: Aug. 16, 2016

(54) TIME-FREQUENCY DIRECTIONAL PROCESSING OF AUDIO SIGNALS

(71) Applicant: Analog Devices, Inc., Norwood, MA (US)

(72) Inventors: Noah Stein, Somerville, MA (US); Johannes Traa, Urbana, IL (US); David Wingate, Ashland, MA (US)

(73) Assignee: Analog Devices, Inc., Norwood, MA (US)

( * ) Notice: Subject to any disclaimer, the term of this patent is extended or adjusted under 35 U.S.C. 154(b) by 22 days.

(21) Appl. No.: 14/494,838

(22) Filed: Sep. 24, 2014

(65) Prior Publication Data

US 2015/0086038 A1 Mar. 26, 2015

Related U.S. Application Data

(63) Continuation-in-part of application No. 14/138,587, filed on Dec. 23, 2013.

(60) Provisional application No. 61/881,678, filed on Sep. 24, 2013, provisional application No. 61/881,709, filed on Sep. 24, 2013, provisional application No. 61/919,851, filed on Dec. 23, 2013, provisional application No. 61/978,707, filed on Apr. 11, 2014.

(51) Int. Cl.
*H04R 1/32* (2006.01)
*G10L 21/0272* (2013.01)
(Continued)

(52) U.S. Cl.
CPC ..... *H04R 1/326* (2013.01); *G10L 21/0272* (2013.01); *G10L 2021/02166* (2013.01); *H04R 1/406* (2013.01); *H04R 2201/003* (2013.01); *H04R 2430/21* (2013.01)

(58) Field of Classification Search
None
See application file for complete search history.

(56) References Cited

U.S. PATENT DOCUMENTS 5,627,899 A 5/1997 Craven et al.
6,688,169 B2 2/2004 Choe
(Continued)

FOREIGN PATENT DOCUMENTS

EP 2007167 12/2008
EP 2237272 10/2010
(Continued)

OTHER PUBLICATIONS

Hu, Rongrong "Directional Speech Acquisition Using a MEMS Cubic Accoustical Sensor Microarray Cluster," retrived from the internet: http://search.proreguest.com/docview/3053009 I 8 [retrieved 71212014].
(Continued)

*Primary Examiner* — Brenda Bernardi
(74) *Attorney, Agent, or Firm* — Patent Capital Group

(57) ABSTRACT

An approach to processing of acoustic signals acquired at a user's device include one or both of acquisition of parallel signals from a set of closely spaced microphones, and use of a multi-tier computing approach in which some processing is performed at the user's device and further processing is performed at one or more server computers in communication with the user's device. The acquired signals are processed using time versus frequency estimates of both energy content as well as direction of arrival. In some examples, a non-negative matrix or tensor factorization approach is used to identify multiple sources each associated with a corresponding direction of arrival of a signal from that source. In some examples, data characterizing direction of arrival information is passed from the user's device to a server computer where direction-based processing is performed.

33 Claims, 4 Drawing Sheets

(51) Int. Cl.

| | |
|---|---|
| *H04R 1/40* | (2006.01) |
| *G10L 21/0216* | (2013.01) |

(56) References Cited

U.S. PATENT DOCUMENTS

| | | | | |
|---|---|---|---|---|
| 6,889,189 | B2 | 5/2005 | Boman | |
| 7,092,539 | B2 | 8/2006 | Sheplak | |
| 7,809,146 | B2 * | 10/2010 | Hiroe | G10L 21/0272 381/94.3 |
| 8,139,788 | B2 * | 3/2012 | Hiroe | H04R 3/005 381/71.1 |
| 8,477,983 | B2 | 7/2013 | Weigold | |
| 8,488,806 | B2 | 7/2013 | Saruwatari et al. | |
| 8,577,054 | B2 | 11/2013 | Hiroe | |
| 2004/0240595 | A1 | 12/2004 | Raphaeli | |
| 2005/0222840 | A1 * | 10/2005 | Smaragdis | G10L 21/0272 704/204 |
| 2008/0031315 | A1 | 2/2008 | Ramirez et al. | |
| 2008/0232607 | A1 | 9/2008 | Tashev et al. | |
| 2008/0288219 | A1 | 11/2008 | Tashev et al. | |
| 2008/0298597 | A1 * | 12/2008 | Turku | H04S 5/00 381/27 |
| 2008/0318640 | A1 | 12/2008 | Takano | |
| 2009/0055170 | A1 | 2/2009 | Nagahama | |
| 2009/0214052 | A1 | 8/2009 | Liu | |
| 2010/0138010 | A1 * | 6/2010 | Aziz Sbai | G10H 1/0008 700/94 |
| 2010/0164025 | A1 | 7/2010 | Yang | |
| 2010/0171153 | A1 | 7/2010 | Yang | |
| 2011/0015924 | A1 | 1/2011 | Gunel Hacihabiboglu et al. | |
| 2011/0054848 | A1 * | 3/2011 | Kim | G10H 1/0008 702/190 |
| 2011/0058685 | A1 * | 3/2011 | Sagayama | G10L 21/0272 381/98 |
| 2011/0081024 | A1 * | 4/2011 | Soulodre | G01S 3/8006 381/17 |
| 2011/0164760 | A1 | 7/2011 | Horibe | |
| 2011/0182437 | A1 * | 7/2011 | Kim | G10L 21/0232 381/73.1 |
| 2011/0307251 | A1 | 12/2011 | Tashev et al. | |
| 2011/0311078 | A1 | 12/2011 | Currano | |
| 2012/0027219 | A1 | 2/2012 | Kale | |
| 2012/0263315 | A1 * | 10/2012 | Hiroe | G10L 21/0216 381/92 |
| 2012/0300969 | A1 | 11/2012 | Tanaka | |
| 2012/0328142 | A1 | 12/2012 | Horibe | |
| 2013/0272538 | A1 | 10/2013 | Kim | |
| 2014/0033904 | A1 | 2/2014 | Swanson | |
| 2014/0133674 | A1 * | 5/2014 | Mitsufuji | H04R 3/00 381/92 |
| 2014/0226838 | A1 * | 8/2014 | Wingate | G10L 21/0272 381/111 |
| 2014/0328487 | A1 * | 11/2014 | Hiroe | G10L 21/0272 381/56 |

FOREIGN PATENT DOCUMENTS

| | | |
|---|---|---|
| WO | WO 2005/122717 | 12/2005 |
| WO | 2015/0048070 | 4/2015 |
| WO | WO 2015/157013 | 10/2015 |

OTHER PUBLICATIONS

Marcos Turqueti et al., "MEMS Accoustic Array Embedded in an FPGA based data acquisition and signal processing system," Circuits and Systems (MWSCAS), 53rd IEEE International Midwest Symposium, Aug. 1, 2010, pp. 1161-1164.

International Search Report and Written Opinion, International Application No. PCT/US2014/016159, mailed Jul. 17, 2014, 10 pages.

Zhang et al., "Two Microphones based direction of arrival estimation for multiple speech sources using spectral properties of speech", IEEE International Conference on Acoustics, Speech and Signal Processing, pp. 2193-2196, Date of Conference, Apr. 19-24, 2009.

International Search Report and Written Opinion issued in International Patent Application Serial No. PCT/US2015/022822 mailed Jul. 23, 2015, 10 pages.

International Search Report in PCT Application Serial No. PCT/US2015/071970 mailed Apr. 23, 2015, 8 pages.

Antoine Liutkus et al., "An Overview of Informed Audio Source Separation", HAL archives-ouvertes, https://hal.archives-ouvertes.fr/hal-00958661, Submitted Mar. 13, 2014, 5 pages.

Hiroshi G. Okuno et al., "Incorporating Visual Information into Sound Source Separation", Kitano Symbiotic System Project, ERATO, Japan Science and Technology Corp. 1996, 9 pages.

Erik Visser et al., "A Spatio-Temporal Speech Enhancement Scheme for Robust Speech Recognition in Noisy Environments", Elsevier, Available at www.computerscienceweb.com, Speech Communication, Received Apr. 1, 2002, Accepted Dec. 5, 2002, 15 pages.

Partial International Search for PCT/US2014/057122 mailed Dec. 22, 2014, 7 pages.

Aoki, M. et al., "Sound Source Segregation Based on Estimating Incident Angle of Each Frequency Component of Input Signals Acquired by Multiple Microphones", Acoustical Science and Technology, Acoustical Society of Japan, Tokyo, JP, vol. 22, No. 2, Mar. 1, 2001, pp. 149-157.

Shujau, M. et al., "Separation of Speech Sources Using an Acoustic Vector Sensor", Multimedia Signal Processing (MMSP), 2001, IEEE 13$^{th}$ International Workshop, IEEE, Oct. 17, 2011, pp. 106.

Shoko, Araki et al., "Blind Sparse Source Separation for Unknown Number of Sources Using Gaussian Mixture Model Fitting with Dirichlet Prior", Acoustics, Speech and Signal Processing, 2009, ICASSP 2009, IEEE International Conference, IEEE, Apr. 19, 2009, pp. 33-36.

Araki, S. et al., "A Robust and Precise Method for Solving the Permutation Problem of Frequency-Domain Blind Source Separation", IEEE Transactions on Speech and Audio Processing, IEEE Service Center, New York, vol. 12, No. 5, Sep. 1, 2004, pp. 530-538.

ISR and WO issued in International Patent Application Serial No. PCT/US2015/022822 mailed Jul. 23, 2015, 16 pages.

Fitzgerald, Derry et al., "Non-Negative Tensor Factorisation for Sound Source Separation", ISSC 2005, Dublin, Sep. 1-2.

OA3 mailed in U.S. Appl. No. 14/138,587 mailed Mar. 30, 2016, 8 pages.

OA1 (Preliminary Rejection) mailed in KR Patent Application Serial No. 10-2015-70118339 mailed Apr. 18, 2016, 6 pages.

English Translation of OA1 (Preliminary Rejection) mailed in KR Patent Application Serial No. 10-2015-70118339 mailed Apr. 18, 2016, 4 pages.

* cited by examiner

TIME-FREQUENCY DIRECTIONAL PROCESSING OF AUDIO SIGNALS

CROSS-REFERENCE TO RELATED APPLICATIONS

This application is a Continuation-in-Part of:

U.S. application Ser. No. 14/138,587, titled "SIGNAL SOURCE SEPARATION," filed on Dec. 23, 2013, and published as U.S. Pat. Pub. 2014/0226838 on Aug. 14, 2014;

and claims the benefit of the following applications:

U.S. Provisional Application No. 61/881,678, titled "TIME-FREQUENCY DIRECTIONAL FACTORIZATION FOR SOURCE SEPARATION," filed on Sep. 24, 2013;

U.S. Provisional Application No. 61/881,709, titled "SOURCE SEPARATION USING DIRECTION OF ARRIVAL HISTOGRAMS," filed on Sep. 24, 2013;

U.S. Provisional Application No. 61/919,851, titled "SMOOTHING TIME-FREQUENCY SOURCE SEPARATION MASKS," filed on Dec. 23, 2013; and U.S. Provisional Application No. 61/978,707, titled "APPARATUS, SYSTEMS, AND METHODS FOR PROVIDING CLOUD BASED BLIND SOURCE SEPARATION SERVICES," filed on Apr. 11, 2014.

Each of the above-referenced applications is incorporated herein by reference.

This application is also related to, but does not claim the benefit of the filing date of, International Application Publication WO2014/047025, titled "SOURCE SEPARATION USING A CIRCULAR MODEL," published on Mar. 27, 2014, which is also incorporated herein by reference.

BACKGROUND

This invention relates to time-frequency directional processing of audio signals.

Use of spoken input for personal user devices, including smartphones, automobiles, etc., can be challenging due to the acoustic environment in which a desired signal from a speaker is acquired. One broad approach to separating a signal from a source of interest using multiple microphone signals is beamforming, which uses multiple microphones separated by distances on the order of a wavelength or more to provide directional sensitivity to the microphone system. However, beamforming approaches may be limited, for example, by inadequate separation of the microphones.

A number of techniques have been developed for unsupervised (e.g., "blind") source separation from a single microphone signal, including techniques that make use of time versus frequency decompositions. Some such techniques make use of Non-Negative Matrix Factorization (NMF). Some techniques have been applied to situations in which multiple microphone signals are available, for example, with widely spaced microphones.

An approach used for speech processing, for example speech recognition, makes use of some processing capacity at a user's device along with transmission of the result of such processing to a server computer, where further processing is performed. An example of such an approach is described, for instance, in U.S. Pat. No. 8,666,963, "Method and Apparatus for Processing Spoken Search Queries."

SUMMARY

In one aspect, an approach to processing of acoustic signals acquired at a user's device include one or both of acquisition of parallel signals from a set of closely spaced microphones, and use of a multi-tier computing approach in which some processing is performed at the user's device and further processing is performed at one or more server computers in communication with the user's device. The acquired signals are processed using time versus frequency estimates of both energy content as well as direction of arrival. In some examples, a non-negative matrix or tensor factorization approach is used to identify multiple sources each associated with a corresponding direction of arrival of a signal from that source. In some examples, data characterizing direction of arrival information is passed from the user's device to a server computer where direction-based processing is performed.

In another aspect, in general, a method for processing a plurality of signals acquired uses a corresponding plurality of acoustic sensors at a user device. The signals have parts from a plurality of spatially distributed acoustic sources. The method comprises: computing, using a processor at the user device, time-dependent spectral characteristics from at least one signal of the plurality of acquired signals, the spectral characteristics comprising a plurality of components; computing, using the processor at the user device, direction estimates from at least two signals of the plurality of acquired signals, each computed component of the spectral characteristics having a corresponding one of the direction estimates; performing a decomposition procedure using the computed spectral characteristics and the computed direction estimates as input to identify a plurality of sources of the plurality of signals, each component of the spectral characteristics having a computed degree of association with at least one of the identified sources and each source having a computed degree of association with at least one direction estimate; and using a result of the decomposition procedure to selectively process a signal from one of the sources.

Aspects may include one or more of the following features in any combination recognizing that unless indicated otherwise none of these features are essential to any particular embodiment.

Each component of the plurality of components of the time-dependent spectral characteristics computed from the acquire signals is associated with a time frame of a plurality of successive time frames. For example, each component of the plurality of components of the time-dependent spectral characteristics computed from the acquired signals is associated with a frequency range, whereby the computed components form a time-frequency characterization of the acquired signals. In at least some examples, each component represents energy (e.g., via a monotonic function, such as square root) at a corresponding range of time and frequency.

Computing the direction estimates of component comprises computing data representing a direction of arrival of the component in the acquired signals. For example, computing the data representing the directional of arrival comprises at least one of (a) computing data representing one direction of arrival, and (b) computing data representing an exclusion of at least one direction of arrival. As another example, computing the data representing the direction of arrival comprises determining an optimized direction associated with the component using at least one of (a) phases, and (b) times of arrivals of the acquired signals. The determining of the optimized direction may comprise performing at least one of (a) a pseudo-inverse calculation, and (b) a least-squared-error estimation. Computing the data representing the direction of arrival may comprise computing at least one of (a) an angle representation of the direction of arrival, (b) a direction vector representation of the direction of arrival, and (c) a quantized representation of the direction of arrival.

Performing the decomposing comprises combining the computed spectral characteristics and the computed direction estimates to form a data structure representing a distribution indexed by time, frequency, and direction. For example, the method may comprise performing a non-negative matrix or tensor factorization using the formed data structure. In some examples, forming the data structure comprises forming data structure representing a sparse data structure in which a majority of the entries of the distribution are absent.

Performing the decomposition comprises determining the result including a degree of association of each component with a corresponding source. In some examples, the degree of association comprises a binary degree of association.

Using the result of the decomposition to selectively process the signal from one of the sources comprises forming a time signal as an estimate of a part of the acquired signals corresponding to said source. For example, forming the time signal comprises using the computed degrees of association of the components with the identified sources to form said time signal.

Using the result of the decomposition to selectively process the signal from one of the sources comprises performing an automatic speech recognition using an estimated part of the acquired signals corresponding to said source.

At least part of performing the decomposition process and using the result of the decomposition procedure is performed as a server computing system in data communication with the user device. For example, the method further comprises communicating from the user device to the server computing system at least one of (a) the direction estimates, (b) a result of the decomposition procedure, and (c) a signal formed using a result of the decomposition as an estimate of a part of the acquired signals. In some examples, the method further comprises communicating a result of the using of the result of the decomposition procedure from the server computing system to the user device. In some examples, the method further comprises communicating data from the server computing system to the user device for use in performing the decomposition procedure at the user device.

In another aspect, in general, a signal processing system, which comprises a processor and an acoustic sensor having multiple sensor elements, is configured to perform all the steps of any one of methods set forth above.

In another aspect, in general, a signal processing system comprises an acoustic sensor, integrated in a user device, having multiple sensor elements, and a processor also integrated in the user device. The processor is configured to: compute, using the processor at the user device, time-dependent spectral characteristics from at least one signal of the plurality of acquired signals, the spectral characteristics comprising a plurality of components; compute, using the processor at the user device, direction estimates from at least two signals of the plurality of acquired signals, each computed component of the spectral characteristics having a corresponding one of the direction estimates; performing a decomposition procedure using the computed spectral characteristics and the computed direction estimates as input to identify a plurality of sources of the plurality of signals, each component of the spectral characteristics having a computed degree of association with at least one of the identified sources and each source having a computed degree of association with at least one direction estimate; and cause use of a result of the decomposition procedure to selectively process a signal from one of the sources.

In some examples, causing use of the result comprises using the processor of the user device to selectively process the signal.

In some examples, the system further comprises a communication interface for communicating with a server computer, and causing use of the result comprises transmitting the result of the decomposition procedure via the communication interface to the server computer.

In another aspect, in general, software comprises instructions embodied on a non-transitory machine readable medium, execution of said instructions on one or more processors of a data processing system causing said system to all the steps of any one of methods set forth above.

One or more aspects address a technical problem of providing accurate processing of acquired acoustic signals within the limits of computation capacity of a user's device. An approach of performing a direction-based processing of the acquired acoustic signals at the user's device permits reduction of the amount of data that needs to be transmitted to a server computer for further processing. Use of the server computer for the further processing, often involving speech recognition, permits use of greater computation resources (e.g., processor speed, runtime and permanent storage capacity, etc.) that may be available at the server computer.

Other features and advantages of the invention are apparent from the following description, and from the claims.

DESCRIPTION

In general, embodiments described herein are directed to a problem of acquiring a set of audio signals, which typically represent a combination of signals from multiple sources, and processing the signals to separate out a signal of a particular source of interest from other undesired signals. At least some of the embodiments are directed to the problem of separating out the signal of interest for the purpose of automated speech recognition when the acquired signals include a speech utterance of interest as well as interfering speech and/or non-speech signals. Other embodiments are directed to problem of enhancement of the audio signal for presentation to a human listener. Yet other embodiments are directed for other forms of automated speech processing, for example, speaker verification or voice-based search queries.

Embodiments also include one or both of (a) acquisition of directional information during acquisition of the audio signals, and (b) processing the audio signals in a multi-tier architecture in which different parts of the processing may be performed on different computing devices, for example, in a client-server arrangement. It should be understood that these two features are independent and that some embodiments may use directional information on a single computing device, and that other embodiments may not use directional information, but may nevertheless use a multi-tier architecture. Finally, at least some embodiments may neither use directional information nor multi-tier architectures, for example, using only time-frequency factorization approaches described below.

Figure 1:
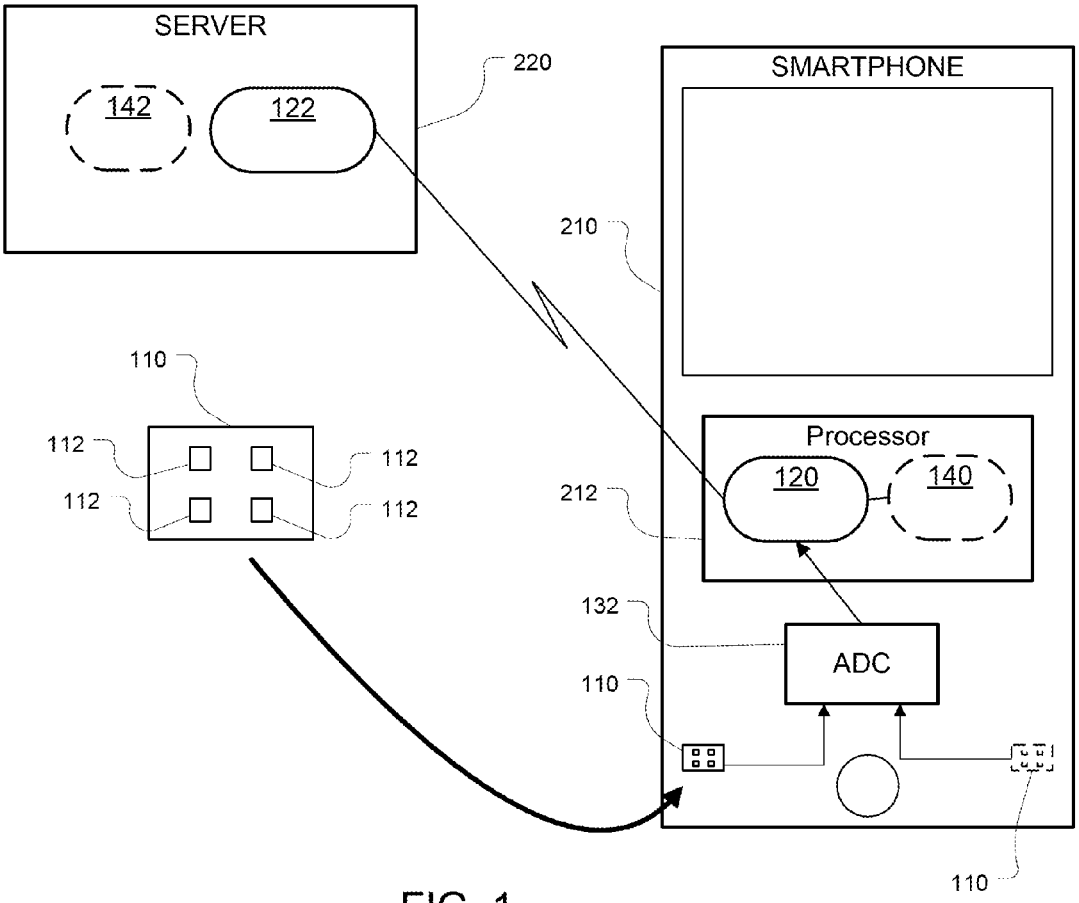
FIG. 1 is a diagram illustrating a representative user device and a server.

Referring to FIG. 1, features that may be present in various embodiments are described in the context of an exemplary embodiment in which multiple personal computing devices, specifically smartphone 210 (only a single of which is illustrated in the figure) include one or more microphones 110, each of which has multiple closely spaced elements (e.g., 1.5 mm, 2 mm, 3 mm spacing). Exemplary structures for these microphones may be found in U.S. Pat. Pub. 2014/0226838. The smartphone includes a processor 212, which is coupled to an Analog-to-Digital Converter (ADC), which provides digitized audio signals acquired at the microphone(s) 110. The processor includes a storage 140, which is used in part for data representing the acquired acoustic signals, and a CPU 120 which implements various procedures described below. The smartphone 210 is coupled to a server 220 over a data link (e.g., over a cellular data connection). The server includes a CPU 122 and associated storage 142. As described below, data passes between the smartphone and the server during and/or immediately following the processing of the audio signals acquired at the smartphone. For example, partially processed audio signals are passed from the smartphone to the server, and results of further processing (e.g., results of automated speech recognition) are passed back from the server to the smartphone. As another example, the server 220 may provide data to the smartphone, e.g. estimated directionality information or spectral prototypes for the sources, which is used at the smartphone to fully or partially process audio signals acquired at the smartphone.

Figure 2:
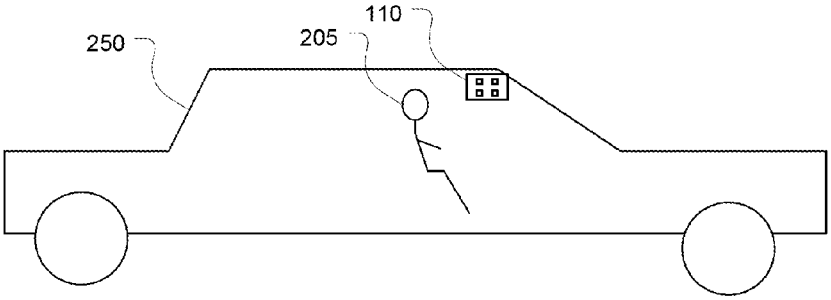
FIG. 2 is a diagram illustrating an automotive application.

It should be understood that a smartphone application is only one of a variety of examples of user devices. Another example is shown in FIG. 2 in which a multi-element microphone is integrated into a vehicle 250, and that at least some of the processing of the acquired audio signals from a speaker 205 are processed using a computing device at the vehicle, and that computing device may optionally communicate with a server to perform at least some of the processing of the acquired signal.

In one example, the multiple element microphone 110 acquires multiple parallel audio signals. For example, the microphone acquires four parallel audio signals from closely spaced elements 112 (e.g., spaced less than 2 mm apart) and passes these as analog signals (e.g., electric or optical signals on separate wires or fibers, or multiplexed on a common wire or fiber) $x_1(t), \ldots, x_4(t)$ to the ADC 132. In general, processing of the acquired audio signals includes performing a time frequency analysis that generates positive real quantities X(f, n), where f is an index over frequency bins and n is an index over time intervals (i.e., frames). For example, Short-Time Fourier Transform (STFT) analysis is performed on the time signals in each of a series of time windows ("frames") shifted 30 ms per increment with 1024 frequency bins, yielding 1024 complex quantities per frame for each input signal. In some implementations, one of the input signals is chosen as a representative, and the quantity X(f,n) representing the magnitude (or alternatively the squared magnitude or compressive transformation of the magnitude, such as a square root) derived from the STFT analysis of the time signal, with the angle of the complex quantities being retained for later reconstruction of a separated time signal. In some implementations, rather than choosing a representative input signal, a combination (e.g., weighted average or the output of a linear beamformer based on previous direction estimates) of the time signals or their STFT representations is used for forming X(f,n) and the associated phase quantities.

In addition to the magnitude-related information, direction-of-arrival (DOA) information is computed from the time signals, also indexed by frequency and frame. For example, continuous incidence angle estimates D(f,n), which may be represented as a scalar or a multi-dimensional vector, are derived from the phase differences of the STFT. An example of a particular direction of arrival calculation approach is as follows. The geometry of the microphones is known a priori and therefore a linear equation for the phase of a signal each microphone can be represented as $\vec{a}_k \cdot \vec{d} + \delta_0 = \delta_k$, where $\vec{a}_k$ is the three-dimensional position of the $k^{th}$ microphone, $\vec{d}$ is a three-dimensional vector in the direction of arrival, $\delta_0$ is a fixed delay common to all the microphones, and $\delta_k = \phi_k/\omega_i$ is the delay observed at the $k^{th}$ microphone for the frequency component at frequency $\omega_i$ computed from the phase $\phi_k$ of the complex STFT of the $k^{th}$ microphone. The equations of the multiple microphones can be expressed as a matrix equation Ax=b where A is a K×4 matrix (K is the number of microphones) that depends on the positions of the microphones, x represent the direction of arrival (a 4-dimensional vector having $\vec{d}$ augmented with a unit element), and b is a vector that represents the observed K phases. This equation can be solved uniquely when there are four non-coplanar microphones. If there are a different number of microphones or this independence isn't satisfied, the system can be solved in a least squares sense. For fixed geometry the pseudoinverse P of A can be computed once (e.g., as a property of the physical arrangement of ports on the microphone) and hardcoded into computation modules that implement an estimation of direction of arrival x as Pb. The direction D is then available directly from the vector direction x. In some examples, the magnitude of the direction vector x, which should be consistent with (e.g., equal to) the speed of sound, is used to determine a confidence score for the direction, for example, representing low confidence if the magnitude is inconsistent with the speed of sound. In some examples, the direction of arrival is quantized (i.e., binned) using a fixed set of directions (e.g., 20 bins), or using an adapted set of directions consistent with the long-term distribution of observed directions of arrival.

Note that the use of the pseudo-inverse approach to estimating direction information is only one example, which is suited to the situation in which the microphone elements are closely spaced, thereby reducing the effects of phase "wrapping." In other embodiments, at least some pairs of microphone elements may be more widely spaced, for example, in a rectangular arrangement with 36 mm ad 63 mm spacing. In such an arrangement, and alternative embodiment makes use of techniques of direction estimation (e.g., linear least squares estimation) as described in International Application Publication WO2014/047025, titled "SOURCE SEPARATION USING A CIRCULAR MODEL." In yet other embodiments, a phase unwrapping approach is applied in combination with a pseudo-inverse approach as described above, for example, using an unwrapping approach to yield approximate delay estimates, followed by application of a pseudo-inverse approach. Of course, on skilled in the art would understand that yet other approaches to processing the signals (and in particular processing phase information of the signals) to yield a direction estimate can be used. Note that by a direction estimate, we mean either a single direction, or at least some representation of direction that excludes certain directions or renders certain directions to be substantially unlikely.

Various embodiments make use of the time-frequency analysis including the magnitude and the direction information as a function of frequency and time, and form a time-frequency mask M(f,n) indexed on the same frequency and time indices that is used to separate the signal of interest in the acquired audio signals. In some examples, a batch approach is used in which a user 205 speaks an utterance and the utterance is acquired as the parallel audio signals $x_1(t), \ldots, x_4(t)$ with the microphone 110. These signals are processed as a unit, for example, computing the entire mask for the duration of the utterance. A number of alterative multi-tier processing approaches are used in different embodiments, including for example:

- The spectral magnitude X(f,n) and direction of arrival D(f,n) are computed at the user's device and then passed to the server, and all remaining processing is performed at one or more server, with the result being passed back to the user's device. In some examples, a multi-tier approach is used in which one server computer performs separation of a desired signal (i.e., a time signal or equivalent representation), with yet another server computer performing further processing of the desired signal.
- The mask is computed at the user's device, and the acquired time signals $x_1(t), \ldots, x_4(t)$ are processed to form a single separated signal $\tilde{x}(t)$, and the separated signal is passed to the server, where it is processed, for example, using an automated speech recognition process.
- The mask is computed as the user's device, and one of the acquired time signals $x_1(t), \ldots, x_4(t)$ (or an average or other combination of) is passed along with the computed mask to the server, where it is processed by the server. In some implementations, the server performs a tandem operation of first separating out the desired signal using the mask and then applying an automated speech recognition process. In some implementations, the mask information is integrated into the speech recognition process, for example, applying a "missing data" approach to estimate the input feature vectors for the automated speech recognition process. In some examples, the acquired time signals are passed to the server as they are collected, and the mask is passed when it is computed by the user's device, thereby reducing the delay.
- In the above approaches, rather than sending a time signal to the server, spectral information, for instance spectral magnitude information from the STFT, is passed to the server. The STFT either represents an input signal and the mask is passed along with the spectral magnitude, of the spectral magnitude of the separated signal is computed at the user's device and passed to the server. The server uses the spectral magnitudes to compute the input feature vectors (e.g., mel-warped cepstra) for automatic speech recognition or other processing without necessarily reconstructing the time signal to be processed.
- In some examples, user's device further processes the STFT of the separated signal, for example, computing the speech recognition feature vectors prior to passing them to the server. One advantage of such processing at the user's device is that the amount of data to be sent to the server may be reduced.
- In some examples, processed audio and/or processed direction information (e.g., direction estimates), which may include compressed audio, compress time-frequency energy distribution, time-frequency based direction of arrival information (which may be encoded as a sparse representation) is passed from the user's device to the server where it is further processed.

In some examples, the user's device does not wait until the completion of the utterance to pass the separated signal or the mask information. For example, sequential or a sliding segment of the input utterance is processed and the information is passed to the server as it is computed.

Figure 3:
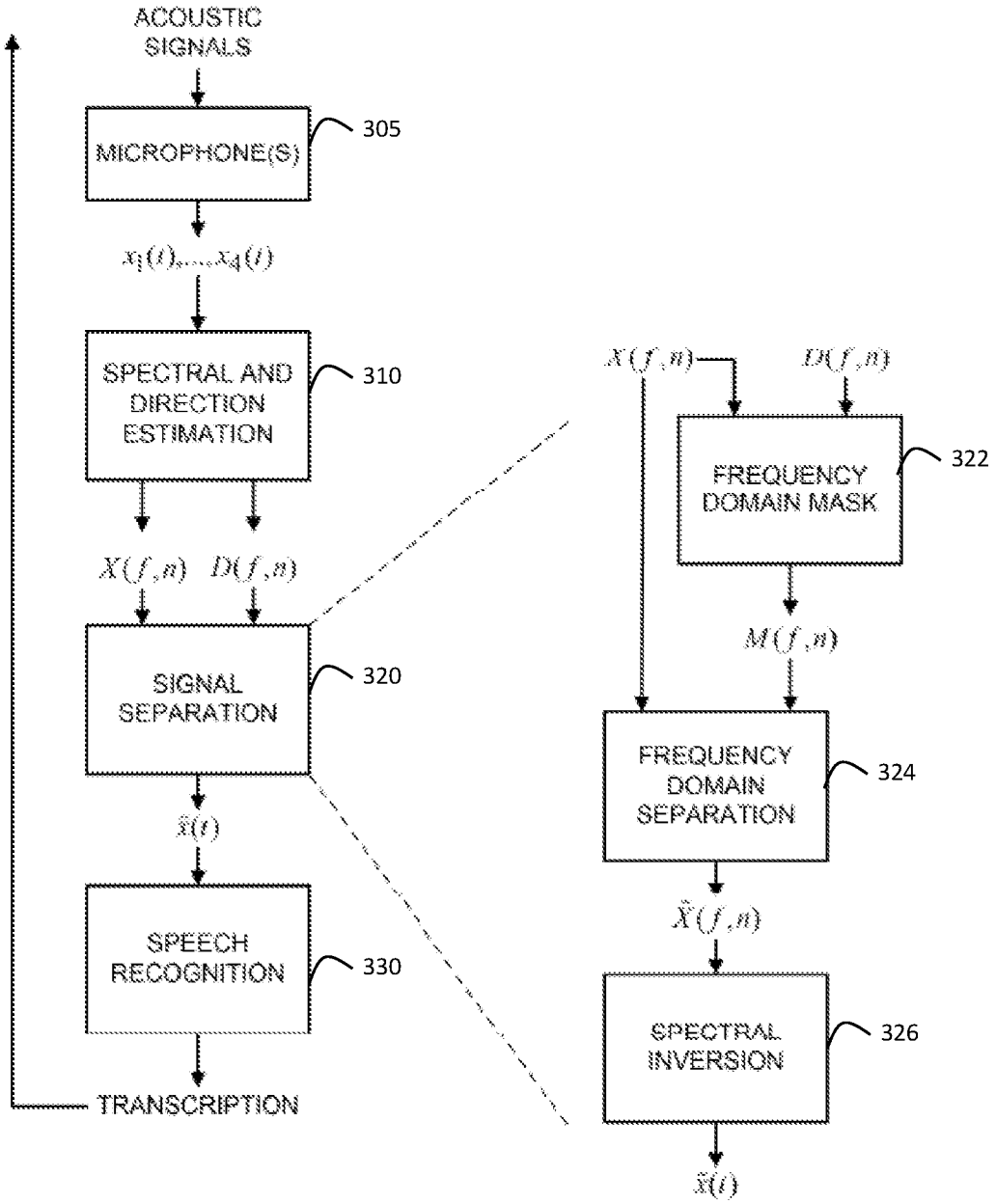
FIG. 3 is a flowchart showing processing of acoustic signals to yield a transcription.

Referring to FIG. 3, an example of the procedure described above is shown in flowchart form in which the acoustic signals $x_1(t), \ldots, x_4(t)$ are acquired by the microphone(s) 110 (stage 305). A spectral estimation and direction estimation stage 310 produces the magnitude and direction information X(f,n) and D(f,n) described above. In at least some embodiments, this information is used in a signal separation stage 320 to produce a separated time signal $\tilde{x}(t)$, and this separated signal is passed to a speech recognition stage 330. The speech recognition stage 330 produces a transcription. As introduced above, in some implementations, the separated signal is determined at the user's device and passed to a server computer where the speech recognition stage 330 is performed, with the transcription being passed back from the server computer to the user's device. In other examples, the transcription is further processed, for example, forming a query (e.g., a Web search) with the results of the query being passed back to the user's device or otherwise processed.

Continuing to refer to FIG. 3, an implementation of the signal separation stage 320 involves first performing a frequency domain mask stage 322, which produces a mask M(f,n). This mask is then used to perform signal separation in the frequency domain producing $\tilde{X}(f,n)$ (stage 324), which then passes to a spectral inversion stage 326 in which the time signal $\tilde{x}(t)$ is determined for example using an inverse transform. Note that in FIG. 3, the flow of the phase information (i.e., the angle of complex quantities indexed by frequency f and time frame n) associated with X(f,n) and $\tilde{X}(f,n)$ is not shown.

Figure 4:
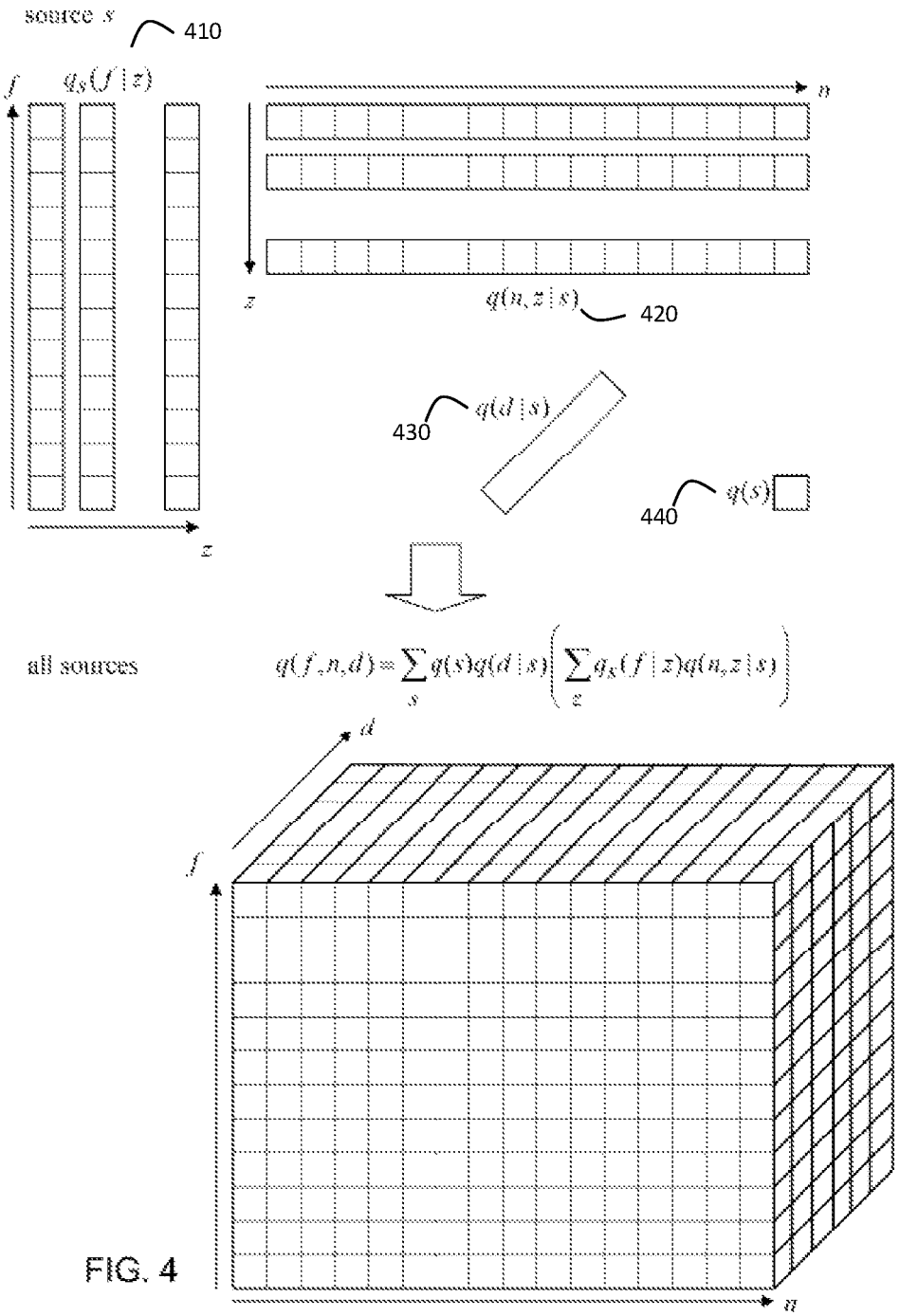
FIG. 4 is a diagram illustrating a Non-Negative Matrix Factorization (NMF) approach to representing a signal distribution.

As discussed more fully below, different implementations implement the signal separation stage 320 in somewhat different ways. Referring to FIG. 4, one approach involves treating using the computed magnitude and direction information from the acquired signals as a distribution $$p(f, n, d) = p(f, n)p(d \mid f, n)$$

where $$p(f, n) = \left( \frac{X(f, n)}{\sum_{f', n'} X(f', n')} \right)$$

and $$p(d \mid f, n) = \begin{cases} 1 & \text{if } D(f, n) = d \\ 0 & \text{otherwise} \end{cases}$$

The distribution p(f,n,d) can be thought of as a probability distribution in that the quantities are all in the range 0.0 to 1.0 and the sum over all the index values is 1.0. Also, it should be understood that the direction distributions p(d|f,n) are not necessarily 0 or 1, and in some implementations may be represented as a distribution with non-zero values for multiple discrete direction values d. In some embodiments, the distribution may be discrete (e.g., using fixed or adaptive direction "bins") or may be represented as a continuous distribution (e.g., a parameterized distribution) over a one-dimensional or multi-dimensional representation of direction.

Very generally, a number of implementations of the signal separation approach are based on forming an approximation q(f,n,d) of p(f,n,d), where the distribution q(f,n,d) has a hidden multiple-source structure. Referring to FIG. 4, one approach to representing the hidden multiple source structure is using a non-negative matrix factorization (NMF) approach, and more particularly a non-negative tensor (i.e., three or more dimensional) factorization approach. The signal is assumed to have been generated by a number of distinct sources, indexed by s=1, . . . , S. Each source is also associated with a number of prototype frequency distributions indexed by z=1, . . . , Z. The prototype frequency distributions q(f|z,s) 410 provide relative magnitudes of various frequency bins, which are indexed by f. The time-varying contributions of the different prototypes for a given source is represented by terms q(n,z|s) 420, which sum to 1.0 over the time frame index values n and prototype index values z. Absent direction information, the distribution over frequency and frame index for a particular source s can be represented as $$q(f, n \mid s) = \sum_{z} q(f \mid z, s) q(n, z \mid s).$$

Direction information in this model is treated, for any particular source, as independent of time and frequency or the magnitude at such times and frequencies. Therefore a distribution q(d|s) 430, which sums to 1.0 for each s, is used. A relative contribution of each source, q(s) 440, sum to 1.0 over the sources. In some implementations, the joint quantity q(d,s)=q(d|s)q(s) is used without separating into the two separate terms. Note that in alternative embodiments, other factorizations of the distribution may be used. For example, $q(f,n|s)=\Sigma_z q(f,z|s)q(n|z,s)$ may be used, encoding an equivalent conditional independence relationship.

The overall distribution q(f,n,d) is then determined from the constituent parts as follows:

$$q(f, n, d) = \sum_{s,z} q(f, n, d, s, z) = \sum_{s} q(s) q(d \mid s) \left( \sum_{z} q(f \mid z, s) q(n, z \mid s) \right).$$

In general, operation of the signal separation phase finds the components of the model to best match the distribution determined from the observed signals. This is expressed as an optimization to minimize a distance between the distribution p( ) determined from the actually observed signals, and q( ) formed from the structured components, the distance function being represented as D(p(f,n,d)||q(f,n,d)). A number of different distance functions may be used. One suitable function is a Kullback-Leibler (KL) divergence, defined as $$D_{KL}\left( p(f, n, d) \| q(f, n, d) \right) = \sum_{f,n,d} p(f, n, d) \ln \frac{p(f, n, d)}{q(f, n, d)}$$

For the KL distance, a number of alternative iterative approaches can be used to find the best structure of q(f,n,d,s,z). One alternative is to use an Expectation-Maximization procedure (EM), or another example of a Minorization-Maximization (MM) procedure. An implementation of the MM procedure used in at least some embodiments can be summarized as follows:

1) Current estimates (indicated by the superscript 0) are known providing the current estimate:

$$q^0(f,n,d,s,z)=q^0(d,s)q_s^0(f|z)q^0(n,z|s)$$

2) A marginal distribution is computed (at least conceptually) as $$q^0(s, z \mid f, n, d) = q^0(f, n, d, s, z) \Big/ \sum_{s,z} q^0(f, n, d, s, z)$$

3) A new joint distribution is computed as $$r(f,t,d,s,z)=p(f,n,d)q^0(s,z|f,n,d)$$

4) New estimates of the components (index by the superscript 1) are computed (at least conceptually) as $$q^1(d, s) = \sum_{f,n,z} r(f, n, d, s, z),$$

$$q^1(f \mid s, z) = \sum_{n,d} r(f, n, d, s, z) \Big/ \sum_{f,n,d} r(f, n, d, s, z),$$

and $$q^1(n, z \mid s) = \sum_{f,d} r(f, n, d, s, z) \Big/ \sum_{f,n,d,z} r(f, n, d, s, z).$$

In some implementations, the iteration is repeated a fixed number of times (e.g., 10 times). Alternative stopping criteria may be used, for example, based on the change in the distance function, change in the estimated values, etc. Note that the computations identified above may be implemented efficiently as matrix computations (e.g., using matrix multiplications), and by computing intermediate quantities appropriately.

In some implementations, a sparse representation of p(f,n,d) is used such that these terms are zero if d≠D(f,n). Steps 2-4 of the iterative procedure outlined above can then be expressed as 2) Compute $$\rho(f,n)=p(f,n)/q^0(f,n,D(f,n))$$

3) New estimates are computed as $$q^1(d, s) = q^0(d, s) \sum_{f,n:\, D(f,n)=d} \rho(f, n) q^0(f, n \mid s),$$

$$q^1(f, s, z) = q^0(f \mid s, z) \sum_{n} \rho(f, n) q^0(D(f, n), s) q^0(n, z \mid s),$$

and $$q^1(n, z \mid s)$$

is computed similarly.

Once the iteration is completed, the mask function may be set as $$M(f, n) = q(s = s^* \mid f, n) = q(f, n, d, s^*, z) \Big/ \sum_{d,s,z} q(f, n, d, s, z)$$

where s* is the index of the desired source. In some examples, the index of the desired source is determined by the estimated direction q(d|s) for the source (e.g., the desired source is in a desired direction), the relative contribution of the source q(s) (e.g., the desired source has the greatest contribution), or both.

A number of different approaches may be used to separate the desired signal using a mask. In one approach, a thresholding approach is used, for example, by setting $$\tilde{X}(f,n)=\begin{cases} X(f,n) & \text{if} \quad M(f,n)>\text{thresh} \\ 0 & \text{otherwise} \end{cases}$$

In another approach, a "soft" masking is used, for example, scaling the magnitude information by M(f,n), or some other monotonic function of the mask, for example, as an element-wise multiplication $$\tilde{X}(f,n)=X(f,n)M(f,n)$$

This latter approach is somewhat analogous to using a time-varying Wiener filter in the case of X(f,n) representing the spectra energy (e.g., squared magnitude of the STFT).

If should also be understood that yet other ways of separating a desired signal from the acquired signals may be based on the estimated decomposition. For example, rather than identifying a particular desired signal, one or more undesirable signals may be identified and their contribution to X(f,n) "subtracted" to form an enhanced representation of the desired signal.

Furthermore, as introduced above, the mask information may be used in directly estimating spectrally-based speech recognition feature vectors, such as cepstra, using a "missing data" approach (see, e.g., Kuhne et al., "Time-Frequency Masking: Linking Blind Source Separation and Robust Speech Recognition," in *Speech Recognition, Technologies and Applications* (2008)). Generally, such approaches treat time-frequency bins in which the source separation approach indicates the desired signal is absent as "missing" in determining the speech recognition feature vectors.

In the discussion above of estimation of the source and direction structured representation of the signal distribution, the estimates may be made independently for different utterances and/or without any prior information. In some embodiments, various sources of information may be used to improve the estimates.

Prior information about the direction of a source may be used. For example, the prior distribution of a speaker relative to a smartphone, or a driver relative to a vehicle-mounted microphone, may be incorporated into the reestimation of the direction information (e.g., the q(d|s) terms), or by keeping these terms fixed without reestimation (or with less frequent reestimation), for example, at being set at prior values. Furthermore, tracking of a hand-held phone's orientation (e.g., using inertial sensors) may be useful in transforming direction information of a speaker relative to a microphone into a form independent of the orientation of the phone. In some implementations, prior information about a desired source's direction may be provided by the user, for example, via a graphical user interface, or may be inherent in the typical use of the user's device, for example, with a speaker being typically in a relatively consistent position relative to the face of a smartphone.

Information about a source's spectral prototypes (i.e., $q_s(f|z)$) may be available from a variety of sources. One source may be a set of "standard" speech-like prototypes. Another source may be the prototypes identified in a previous utterance. Information about a source may also be based on characterization of expected interfering signals, for example, wind noise, windshield wiper noise, etc. This prior information may be used in a statistical prior model framework, or may be used as an initialization of the iterative optimization procedures described above.

In some implementations, the server provides feedback to the user device that aids the separation of the desired signal. For example, the user's device may provide the spectral information X(f,n) to the server, and the server through the speech recognition process may determine appropriate spectral prototypes $q_s(f|z)$ for the desired source (or for identified interfering speech or non-speech sources) back to the user's device. The user's device may then uses these as fixed, as prior estimates, or initializations for iterative re-estimation.

It should be understood that the particular structure for the distribution model, and the procedures for estimation of the components of the model, presented above are not the only approach. Very generally, in addition to non-negative matrix factorization, other approaches such as Independent Components Analysis (ICA) may be used.

In yet another novel approach to forming a mask and/or separation of a desired signal the acquired acoustic signals are processed by computing a time versus frequency distribution P(f,n) based on one or more of the acquired signals, for example, over a time window. The values of this distribution are non-negative, and in this example, the distribution is over a discrete set of frequency values $f\epsilon[1,F]$ and time values $n\epsilon[1,N]$. In some implementations, the value of $P(f,n_0)$ is determined using a Short Time Fourier Transform at a discrete frequency f in the vicinity of time $t_0$ of the input signal corresponding to the $n_0^{th}$ analysis window (frame) for the STFT.

In addition to the spectral information, the processing of the acquired signals also includes determining directional characteristics at each time frame for each of multiple components of the signals. One example of components of the signals across which directional characteristics are computed are separate spectral components, although it should be understood that other decompositions may be used. In this example, direction information is determined for each (f,n) pair, and the direction of arrival estimates on the indices as D(f,n) are determined as discretized (e.g., quantized) values, for example $d\epsilon[1,D]$ for D (e.g., 20) discrete (i.e., "binned") directions of arrival.

For each time frame of the acquired signals, a directional histogram P(d|n) is formed representing the directions from which the different frequency components at time frame n originated from. In this embodiment that uses discretized directions, this direction histogram consists of a number for each of the D directions: for example, the total number of frequency bins in that frame labeled with that direction (i.e., the number of bins f for which D(f,n)=d. Instead of counting the bins corresponding to a direction, one can achieve better performance using the total of the STFT magnitudes of these bins (e.g., $P(d|n)\propto\Sigma_{f:D(f,n)=d}P(f|n)$), or the squares of these magnitudes, or a similar approach weighting the effect of higher-energy bins more heavily. In other examples, the processing of the acquired signals provides a continuous-valued (or finely quantized) direction estimate D(f,n) or a parametric or non-parametric distribution P(d|f,n), and either a histogram or a continuous distribution P(d|n) is computed from the direction estimates. In the approaches below, the case where P(d|n) forms a histogram (i.e., values for discrete values of d) is described in detail, however it should be understood that the approaches may be adapted to address the continuous case as well.

The resulting directional histogram can be interpreted as a measure of the strength of signal from each direction at each time frame. In addition to variations due to noise, one would expect these histograms to change over time as some sources turn on and off (for example, when a person stops speaking little to no energy would be coming from his general direction, unless there is another noise source behind him, a case we will not treat).

One way to use this information would be to sum or average all these histograms over time (e.g., as $\overline{P}(d)=(1/N)\Sigma_n P(d|n)$). Peaks in the resulting aggregated histogram then correspond to sources. These can be detected with a peak-finding algorithm and boundaries between sources can be delineated by for example taking the midpoints between peaks.

Another approach is to consider the collection of all directional histograms over time and analyze which directions tend to increase or decrease in weight together. One way to do this is to compute the sample covariance or correlation matrix of these histograms. The correlation or covariance of the distributions of direction estimates is used to identify separate distributions associated with different sources. One such approach makes use of a covariance of the direction histograms, for example, computed as $$Q(d_1,d_2)=(1/N)\Sigma_n(P(d_1|n)-\overline{P}(d_1))(P(d_2|n)-\overline{P}(d_2))$$

where $\overline{P}(d)=(1/N)\Sigma_n P(d|n)$, which can be represented in matrix form as $$Q=(1/N)\Sigma_n(P(n)-\overline{P})(P(n)-\overline{P})^T$$

where P(n) and $\overline{P}$ are D-dimensional column vectors.

A variety of analyses can be performed on the covariance matrix Q or on a correlation matrix. For example, the principal components of Q (i.e., the eigenvectors associated with the largest eigenvalues) may be considered to represent prototypical directional distributions for different sources.

Other methods of detecting such patterns can also be employed to the same end. For example, computing the joint (perhaps weighted) histogram of pairs of directions at a time and several (say 5—there tends to be little change after only 1) frames later, averaged over all time, can achieve a similar result.

Another way of using the correlation or covariance matrix is to form a pairwise "similarity" between pairs of directions $d_1$ and $d_2$. We view the covariance matrix as a matrix of similarities between directions, and apply a clustering method such as affinity propagation or k-medoids to group directions which correlate together. The resulting clusters are then taken to correspond to individual sources.

In this way a discrete set of sources in the environment is identified and a directional profile for each is determined. These profiles can be used to reconstruct the sound emitted by each source using the masking method described above. They can also be used to present a user with a graphical illustration of the location of each source relative to the microphone array, allowing for manual selection of which sources to pass and block or visual feedback about which sources are being automatically blocked.

In another embodiment, input mask values over a set of time-frequency locations that are determined by one or more of the approaches described above. These mask values may have local errors or biases. Such errors or biases have the potential result that the output signal constructed from the masked signal has undesirable characteristics, such as audio artifacts.

As an optional feature that can be combined with the approaches described above, the determined mask information may be "smoothed." For example, one general class of approaches to "smoothing" or otherwise processing the mask values makes use of a binary Markov Random Field treating the input mask values effectively as "noisy" observations of the true but not known (i.e., the actually desired) output mask values. A number of techniques described below address the case of binary masks, however it should be understood that the techniques are directly applicable, or may be adapted, to the case of non-binary (e.g., continuous or multi-valued) masks. In many situations, sequential updating using the Gibbs algorithm or related approaches may be computationally prohibitive. Available parallel updating procedures may not be available because the neighborhood structure of the Markov Random Field does not permit partitioning of the locations in such a way as to enable current parallel update procedures. For example, a model that conditions each value on the eight neighbors in the time-frequency grid is not amenable to a partition into subsets of locations of exact parallel updating.

Another approach is disclosed herein in which parallel updating for a Gibbs-like algorithm is based on selection of subsets of multiple update locations, recognizing that the conditional independence assumption may be violated for many locations being updated in parallel. Although this may mean that the distribution that is sampled is not precisely the one corresponding to the MRF, in practice this approach provides useful results.

A procedure presented herein therefore repeats in a sequence of update cycles. In each update cycle, a subset of locations (i.e., time-frequency components of the mask) is selected at random (e.g., selecting a random fraction, such as one half), according to a deterministic pattern, or in some examples forming the entire set of the locations.

When updating in parallel in the situation in which the underlying MRF is homogeneous, location-invariant convolution according to a fixed kernel is used to compute values at all locations, and then the subset of values at the locations being updated are used in a conventional Gibbs update (e.g., drawing a random value and in at least some examples comparing at each update location). In some examples, the convolution is implemented in a transform domain (e.g., Fourier Transform domain). Use of the transform domain and/or the fixed convolution approach is also applicable in the exact situation where a suitable pattern (e.g., checkerboard pattern) of updates is chosen, for example, because the computational regularity provides a benefit that outweighs the computation of values that are ultimately not used.

Figure 5:
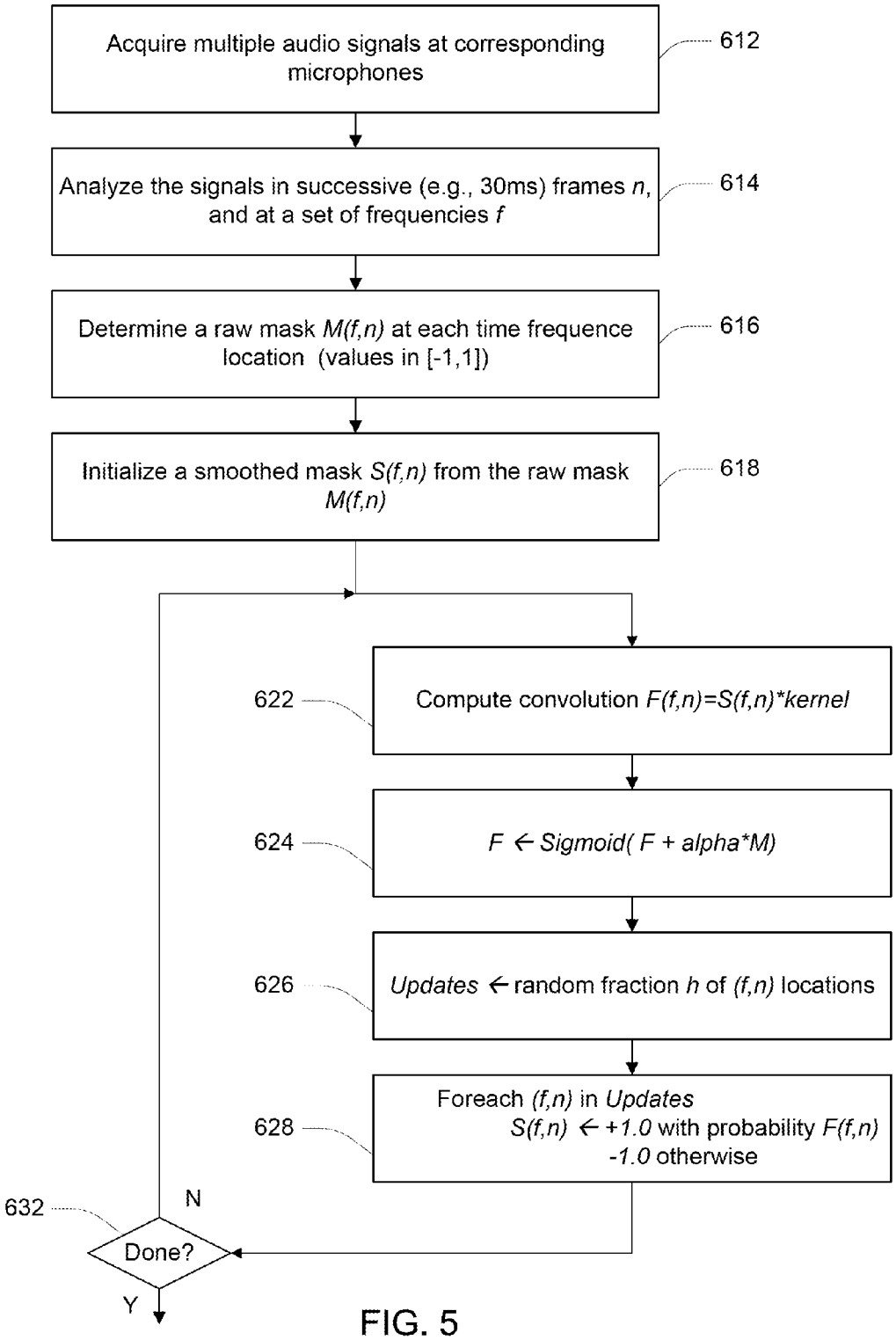
FIG. 5 is a flowchart.

A summary of the procedure is illustrated in the flowchart of FIG. 5. Note that the specific order of steps may be altered in some implementations, and steps may be implemented in using different mathematical formulations without altering the essential aspects of the approach. First, multiple signals, for instance audio signals, are acquired at multiple sensors (e.g., microphones) (step 612). In at least some implementations, relative phase information at successive analysis frames (n) and frequencies (f) is determined in an analysis step (step 614). Based on this analysis, a value between −1.0 (i.e., a numerical quantity representing "probably off") and +1.0 (i.e., a numerical quantity representing "probably on") is determined for each time-frequency location as the raw (or input) mask M(f,n) (step 616). Of course in other applications, the input mask is determined in other ways than according to phase or direction of arrival information. An output of this procedure is to determine a smoothed mask S(f,n), which is initialized to be equal to the raw mask (step 618). A sequence of iterations of further steps is performed, for example terminating after a predetermined number of iterations (e.g., 50 iterations). Each iteration begins with a convolution of the current smoothed mask with a local kernel to form a filtered mask (step 622). In some examples, this kernel extends plus and minus one sample in time and frequency, with weights:

$$\begin{bmatrix} 0.25 & 0.5 & 0.25 \\ 1.0 & 0.0 & 1.0 \\ 0.25 & 0.5 & 0.25 \end{bmatrix}$$

A filtered mask F(f,n), with values in the range 0.0 to 1.0 is formed by passing the filtered mask plus a multiple a times the original raw mask through a sigmoid $1/(1+\exp(-x))$ (step 124), for example, for $\alpha=2.0$. A subset of a fraction h of the (f,n) locations, for example h=0.5, is selected at random or alternatively according to a deterministic pattern (step 626). Iteratively or in parallel, the smoothed mask S at these random locations is updated probabilistically such that a location (f,n) selected to be updated is set to +1.0 with a probability F(f,n) and −1.0 with a probability (1−F(f,n)) (step 628). An end of iteration test (step 632) allows the iteration of steps 122-128 to continue, for example for a predetermined number of iterations.

A further computation (not illustrated in the flowchart of FIG. 5) is optionally performed to determine a smoothed filtered mask SF(f,n). This mask is computed as the sigmoid function applied to the average of the filtered mask computed over a trailing range of the iterations, for example, with the average computed over the last 40 of 50 iterations, to yield a mask with quantities in the range 0.0 to 1.0.

Implementations of the approaches described above may be implemented in software, in hardware, or in a combination of hardware and software. For example, in a user's device (e.g., a smartphone), processing of the acquired acoustic signals may be performed in a general-purpose processor, in a special purpose processor (e.g., a signal processor, or a processor coupled to or embedded in a microphone unit), or may be implemented using special purpose circuitry (e.g., an Application Specific Integrated Circuit, ASIC). Software may include instructions stored on a non-transitory medium (e.g., a semiconductor storage device) or transferred to a user's device over a data network and at least temporarily stored in the data network. Similarly, server implementations include one or more processors, and non-transitory machine-readable storage for instructions for implementing server-side procedures described above.

It is to be understood that the foregoing description is intended to illustrate and not to limit the scope of the invention, which is defined by the scope of the appended claims. Other embodiments are within the scope of the following claims.

What is claimed is:

1. A method for processing a plurality of signals acquired using a corresponding plurality of acoustic sensors at a user device, said signals having parts from a plurality of spatially distributed acoustic sources, the method comprising:

computing, using a processor at the user device, time-dependent spectral characteristics from at least one signal of the plurality of acquired signals, the spectral characteristics comprising a plurality of components, each component associated with a respective pair of frequency (f) and time (n) values;

computing, using the processor at the user device, direction estimates from at least two signals of the plurality of acquired signals, each computed component of the spectral characteristics having a corresponding one of the direction estimates (d);

combining the computed spectral characteristics and the computed direction estimates to form a data structure representing a distribution p(f,n,d) indexed by frequency (f), time (n), and direction (d);

forming an approximation q(f,n,d) of the distribution p(f,n,d), the approximation having a hidden multiple-source structure assuming that the at least one signal of the plurality of acquired signals was generated by a number of distinct acoustic sources indexed by s=1, . . . , S and each acoustic source is associated with a number of prototype frequency distributions indexed by z=1, . . . , Z so that the approximation can be factorized into constituent parts;

performing a plurality of iterations of adjusting components of a model of the approximation q(f,n,d) to match the distribution p(f,n,d); and computing a mask function M(f,n) for separating a contribution of a selected acoustic source (s*) of the plurality of spatially distributed acoustic sources from at least one signal of the plurality of acquired signals using the constituent parts of the approximation corresponding to the selected source (s*).

2. The method of claim 1, wherein each component of the plurality of components of the time-dependent spectral characteristics computed from the acquired signals is associated with a time frame of a plurality of successive time frames.

3. The method of claim 2, wherein each component of the plurality of components of the time-dependent spectral characteristics computed from the acquire signals is associated with a frequency range, whereby the computed components form a time-frequency characterization of the acquired signals.

4. The method of claim 3, wherein each component represents energy at a corresponding range of time and frequency.

5. The method of claim 1, wherein computing the direction estimates of a component comprises computing data representing a direction of arrival of the component in the acquired signals.

6. The method of claim 5, wherein computing the data representing the directional of arrival comprises at least one of (a) computing data representing one direction of arrival, and (b) computing data representing an exclusion of at least one direction of arrival.

7. The method of claim 5, wherein computing the data representing the direction of arrival comprises determining an optimized direction associated with the component using at least one of (a) phases, and (b) times of arrivals of the acquired signals.

8. The method of claim 7, wherein determining the optimized direction comprises performing at least one of (a) a pseudo-inverse calculation, and (b) a least-squared-error estimation.

9. The method of claim 5, wherein computing the data representing the direction of arrival comprises computing at least one of (a) an angle representation of the direction of arrival, (b) a direction vector representation of the direction of arrival, and (c) a quantized representation of the direction of arrival.

10. The method of claim 1, further comprising performing a non-negative tensor factorization using the formed data structure.

11. The method of claim 1, wherein forming the data structure comprises forming a sparse data structure in which a majority of the entries of the distribution are absent.

12. The method of claim 1, wherein the mask function is computed after the plurality of iterations are completed.

13. The method of claim 1, further comprising applying the mask function M(f,n) to at least one signal of the plurality of acquired signals to estimate a part of the at least one signal of the plurality of acquired signals corresponding to the selected acoustic source.

14. The method of claim 13, further comprising performing an automatic speech recognition using the estimated part of the at least one signal of the plurality of acquired signals corresponding to the selected acoustic source.

15. The method of claim 1, wherein at least part of forming the approximation q(f,n,d), performing the plurality of iterations, and computing the mask function M(f,n) is performed at a server computing system in data communication with the user device.

16. The method of claim 15, further comprising communicating from the user device to the server computing system at least one of (a) the direction estimates, (b) a result of performing the plurality of iterations, and (c) a signal formed as an estimate of a part of the at least one signal of the plurality of acquired signals corresponding to the selected acoustic source.

17. A signal processing system comprising:

an acoustic sensor, integrated in a user device, having multiple sensor elements; and a processor integrated in the user device;

wherein the processor is configured to compute, using the processor at the user device, time-dependent spectral characteristics from at least one signal of the plurality of acquired signals, the spectral characteristics comprising a plurality of components, each component associated with a respective pair of frequency (f) and time (n) values;

compute, using the processor at the user device, direction estimates from at least two signals of the plurality of acquired signals, each computed component of the spectral characteristics having a corresponding one of the direction estimates (d);

combine the computed spectral characteristics and the computed direction estimates to form a data structure representing a distribution p(f,n,d) indexed by frequency (f), time (n), and direction (d);

form an approximation q(f,n,d) of the distribution p(f,n,d), the approximation having a hidden multiple-source structure assuming that the at least one signal of the plurality of acquired signals was generated by a number of distinct acoustic sources indexed by s=1, . . . , S and each acoustic source is associated with a number of prototype frequency distributions indexed by z=1, . . . , Z so that the approximation can be factorized into constituent parts;

perform a plurality of iterations of adjusting components of a model of the approximation q(f,n,d) to match the distribution p(f,n,d); and compute a mask function M(f,n) for separating a contribution of a selected acoustic source (s*) of the plurality of spatially distributed acoustic sources from at least one signal of the plurality of acquired signals using the constituent parts of the approximation corresponding to the selected source (s*).

18. The signal processing system of claim 17, wherein the processor is further configured to use the mask function M(f,n) with at least one signal of the plurality of acquired signals to estimate a part of the at least one signal of the plurality of acquired signals corresponding to the selected acoustic source.

19. The signal processing system of claim 18, wherein the processor is further configured to perform an automatic speech recognition using the estimated part of the at least one signal of the plurality of acquired signals corresponding to the selected acoustic source.

20. The signal processing system of claim 18, further comprising a communication interface for communicating with a server computing system, and wherein using the mask function M(f,n) with at least one signal of the plurality of acquired signals comprises transmitting the mask function M(f,n) and/or the constituent parts of the factorization via the communication interface to the server computer.

21. The signal processing system of claim 17, further comprising a communication interface for communicating with a server computing system, and wherein forming the approximation q(f,n,d) of the distribution p(f,n,d) comprises providing information indicative of the distribution p(f,n,d) to the server computing system and receiving the approximation q(f,n,d) of the distribution p(f,n,d) or information that enables forming the approximation q(f,n,d) of the distribution p(f,n,d) from the server computing system.

22. The signal processing system of claim 21, further comprising communicating from the user device to the server computing system at least one of (a) the direction estimates, (b) a result of performing the plurality of iterations, and (c) a signal formed as an estimate of a part of the at least one signal of the plurality of acquired signals corresponding to the selected acoustic source.

23. The signal processing system of claim 17, wherein each component of the plurality of components of the time-dependent spectral characteristics computed from the acquired signals is associated with a time frame of a plurality of successive time frames.

24. The signal processing system of claim 23, wherein each component of the plurality of components of the time-dependent spectral characteristics computed from the acquire signals is associated with a frequency range, whereby the computed components form a time-frequency characterization of the acquired signals.

25. The signal processing system of claim 24, wherein each component represents energy at a corresponding range of time and frequency.

26. A signal processing system for processing a plurality of signals acquired using a corresponding plurality of acoustic sensors, said signals having parts from a plurality of spatially distributed acoustic sources, the system comprising:

means for computing time-dependent spectral characteristics from at least one signal of the plurality of acquired signals, the spectral characteristics comprising a plurality of components, each component associated with a respective pair of frequency (f) and time (n) values;

means for computing direction estimates from at least two signals of the plurality of acquired signals, each computed component of the spectral characteristics having a corresponding one of the direction estimates (d);

means for combining the computed spectral characteristics and the computed direction estimates to form a data structure representing a distribution p(f,n,d) indexed by frequency (f), time (n), and direction (d);

means for forming an approximation q(f,n,d) of the distribution p(f,n,d), the approximation having a hidden multiple-source structure assuming that the at least one signal of the plurality of acquired signals was generated by a number of distinct acoustic sources indexed by s=1, . . . , S and each acoustic source is associated with a number of prototype frequency distributions indexed by z=1, . . . , Z so that the approximation can be factorized into constituent parts;

means for performing a plurality of iterations of adjusting components of a model of the approximation q(f,n,d) to match the distribution p(f,n,d); and means for computing a mask function M(f,n) for separating a contribution of a selected acoustic source (s*) of the plurality of spatially distributed acoustic sources from at least one signal of the plurality of acquired signals using the constituent parts of the approximation corresponding to the selected source (s*).

27. The signal processing system of claim 26, further comprising means for applying the mask function M(f,n) to at least one signal of the plurality of acquired signals to estimate a part of the at least one signal of the plurality of acquired signals corresponding to the selected acoustic source.

28. The signal processing system of claim 27, further comprising means for performing an automatic speech recognition using the estimated part of the at least one signal of the plurality of acquired signals corresponding to the selected acoustic source.

29. A non-transitory machine readable medium storing instructions such that execution of said instructions on one or more processors of a data processing system causes said system to compute time-dependent spectral characteristics from at least one signal of the plurality of acquired signals, the spectral characteristics comprising a plurality of components, each component associated with a respective pair of frequency (f) and time (n) values;

compute direction estimates from at least two signals of the plurality of acquired signals, each computed component of the spectral characteristics having a corresponding one of the direction estimates (d);

combine the computed spectral characteristics and the computed direction estimates to form a data structure representing a distribution p(f,n,d) indexed by frequency (f), time (n), and direction (d);

form an approximation q(f,n,d) of the distribution p(f,n,d), the approximation having a hidden multiple-source structure assuming that the at least one signal of the plurality of acquired signals was generated by a number of distinct acoustic sources indexed by s=1, . . . , S and each acoustic source is associated with a number of prototype frequency distributions indexed by z=1, . . . , Z so that the approximation can be factorized into constituent parts;

perform a plurality of iterations of adjusting components of a model of the approximation q(f,n,d) to match the distribution p(f,n,d); and compute a mask function M(f,n) for separating a contribution of a selected acoustic source (s*) of the plurality of spatially distributed acoustic sources from at least one signal of the plurality of acquired signals using the constituent parts of the approximation corresponding to the selected source (s*).

30. The non-transitory machine readable medium of claim 29, wherein execution of said instructions further causes said system to apply the mask function M(f,n) to at least one signal of the plurality of acquired signals to estimate a part of the at least one signal of the plurality of acquired signals corresponding to the selected acoustic source.

31. The non-transitory machine readable medium of claim 30, wherein execution of said instructions further causes said system to perform an automatic speech recognition using the estimated part of the at least one signal of the plurality of acquired signals corresponding to the selected acoustic source.

32. The non-transitory machine readable medium of claim 29, wherein execution of said instructions further causes said system to perform a non-negative tensor factorization using the formed data structure.

33. The non-transitory machine readable medium of claim 29, wherein forming the data structure comprises forming a sparse data structure in which a majority of the entries of the distribution are absent.

* * * * *